US005097741A

United States Patent [19]

Kikumoto

[11] Patent Number: 5,097,741

[45] Date of Patent: Mar. 24, 1992

[54] ELECTRONIC MUSICAL INSTRUMENT WITH TONE VOLUMES DETERMINED ACCORDING TO MESSAGES HAVING CONTROLLED MAGNITUDES

[75] Inventor: Tadao Kikumoto, Shizuoka, Japan

[73] Assignee: Roland Corporation, Osaka, Japan

[21] Appl. No.: 459,330

[22] Filed: Dec. 29, 1989

[51] Int. Cl.[5] ..... G10H 1/02; G10H 1/32; G10H 1/46

[52] U.S. Cl. ..... 84/626; 84/633; 84/658; 84/665

[58] Field of Search ..... 84/617, 618, 613, 623, 84/626, 631, 633, 658, 665, 711, 741

[56] References Cited

U.S. PATENT DOCUMENTS

| | | | |
|---|---|---|---|
| 4,244,261 | 1/1981 | Adachi . | |
| 4,416,178 | 11/1983 | Ishida | 84/DIG. 7 |
| 4,528,885 | 7/1985 | Chihana | 84/626 |
| 4,651,611 | 3/1987 | Deforeit | 84/617 |
| 4,674,382 | 6/1987 | Yorihisa | 84/626 |
| 4,875,400 | 8/1989 | Okuda et al. | 84/626 |
| 4,911,052 | 3/1990 | Saito et al. | 84/617 |
| 4,947,724 | 8/1990 | Hirano et al. | 84/631 |
| 4,969,385 | 11/1990 | Williams et al. | 84/656 |

FOREIGN PATENT DOCUMENTS

| | | |
|---|---|---|
| 0192984 | 9/1986 | European Pat. Off. . |
| 0206786 | 12/1986 | European Pat. Off. . |
| 53-87120 | 10/1978 | Japan . |
| 62-195189 | 12/1987 | Japan . |
| 2090693 | 7/1982 | United Kingdom . |

*Primary Examiner*—William M. Shoop, Jr.
*Assistant Examiner*—Brian Sircus
*Attorney, Agent, or Firm*—Beveridge, DeGrandi & Weilacher

[57] ABSTRACT

An electronic musical instrument is disclosed as including a tone pitch-assigning device which assigns pitches to musical tones which are to be generated by the instrument; a plurality of manually operable members; a control message-producing device that automatically produces musical tone-controlling messages which respectively correspond to operation of the manually operable members; and a musical tone-generating device which automatically generates a plurality of musical tones for each of the musical pitches assigned by the tone pitch-assigning device. The tone volumes of the musical tones are controlled based upon the tone-controlling messages so that the musical tone-generating device generates musical tones with tone volumes which may change in time, which may maintain a constant volume, or which may be attenuated, depending upon certain predetermined conditions.

6 Claims, 7 Drawing Sheets

ELECTRONIC MUSICAL INSTRUMENT WITH TONE VOLUMES DETERMINED ACCORDING TO MESSAGES HAVING CONTROLLED MAGNITUDES

BACKGROUND OF THE INVENTION

1. Field of the Invention

The invention relates to an electronic musical instrument in which musical tones of assigned pitches are generated in such a manner that the musical tones are controlled according to operation of musical tone-controlling means such as manually operable members.

2. Description of Related Art

There are known some electronic musical instruments comprising modulation levers or foot pedals which are provided as musical tone-controlling means and are utilized to conduct alteration of musical tone parameters during the playing of music. There are also known some timbre-selecting switches which are incorporated in such electronic musical instruments in order to quickly change one timbre to another during the playing of music because simple alteration of the musical parameters cannot produce various timbres.

SUMMARY OF THE INVENTION

The timbre-selecting switches however have failed also to provide a large range of timbre variation since only one musical tone is generated corresponding to one assigned musical pitch. Further, sudden change from a previous timbre to a new timbre makes it very difficult to produce a natural and smooth feeling as to alteration of timbres. The present invention was made to resolve those problems, and an object of the invention is to provide an electronic musical instrument in which plural musical tones and/or plural timbres can be produced in response to each assigned pitch and which affords a large variety of smooth timbre alterations with each tone or timbre being controlled properly.

According to the invention which accomplishes the above mentioned object, an electronic musical instrument comprises the following structural features as shown in FIG. 1, namely:

(a) tone pitch-assigning means (1) assigning pitches to musical tones which are to be generated, (b) a plurality of manually operable members (2), (c) control message-producing means (3) automatically producing musical tone-controlling messages which respectively correspond to operations of the manually operable members (2), and (d) musical tone-generating means (4) which automatically generate a plurality of musical tones for each of the musical pitches assigned by the tone pitch-assigning means (1), the musical tones respectively being of controlled volumes which respectively correspond to the tone-controlling messages produced in the control message-producing means (3).

In such a system, the control message-producing means (3) automatically produces the musical tone-controlling messages which respectively correspond to the operations of said plurality of the manually operable members (2). Each of the musical tone-controlling messages thus produced is then utilized in the musical tone-generating means (4) to generate one of the musical tones with a controlled volume. Therefore, the plurality of said musical tones are generated by said generating means (4) for each of the assigned pitches.

It will be understood that smoother and more varied modes of timbre alterations are afforded by the invention because musical tones of plural kinds or timbres are simultaneously generated for every pitch which is assigned during the playing of music, the volumes of musical tones thereby being controlled in response to the musical tone-controlling messages which also are being produced simultaneously with each other.

The present invention may also be embodied in such a way that magnitudes of the musical tone-controlling messages for the musical tones which are to be generated are subjected to changes in the course of time and in response to speed or rapidity of the operation of aforementioned manually operable members. The magnitudes of the musical tone-controlling messages for musical tones to be generated are caused to change in the course of time when the manually operable members are operated into their ON-states whereas the magnitudes remain unchanged when said manually operable members are operated into their OFF-states.

Further, the control message-producing means may produce the musical tone-controlling messages which are of such magnitudes that cause attenuation of the musical tones corresponding to some manually operable members other than those which are just newly operated, on a condition that said some manually operable members are in their unoperated states, or on a condition that said newly operated members are operated at a speed higher than a predetermined speed. To the contrary, the control message-producing means may also produce the musical tone-controlling messages which are of such magnitudes that attenuates the musical tones corresponding to some manually operable members when these members are operated at a speed lower than the predetermined speed.

BRIEF DESCRIPTION OF THE DRAWINGS

The present invention will become more apparent from the detailed description and the accompanying drawings, wherein:

FIGS. 2 to 9 illustrate an electronic musical instrument in an embodiment of the invention; in which FIG. 2 shows in outline the musical instrument, FIG. 3 illustrates memory areas in a RAM, FIG. 4 shows data which are stored in a table, FIGS. 5, 7 and 8 are flowcharts respectively showing a timer-interrupt processing, key-on-event processing and a key-off-event processing which are executed in a microcomputer, FIG. 6 is a graph illustrating the timer-interrupt processing, FIGS. 9(*a*) and 9(*b*) are time charts showing relationships between control signals and key-depression/-release of keys included in a second part of a keyboard.

DETAILED DESCRIPTION OF THE PREFERRED EMBODIMENTS

Figure 1:
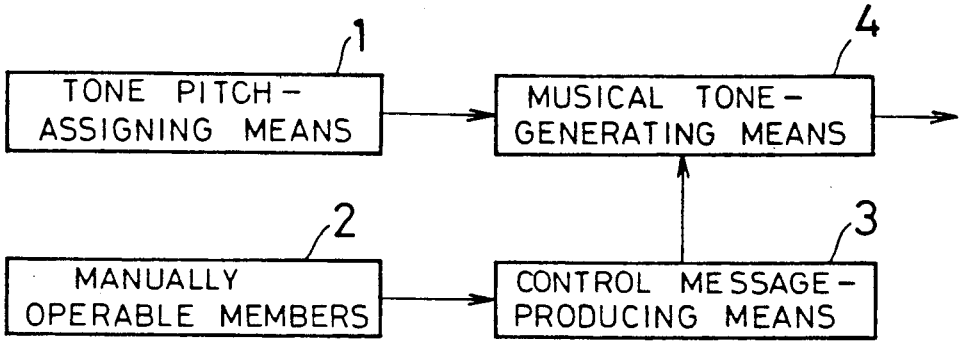
FIG. 1 is a block diagram showing the invention as defined in the claims.

Preferred embodiments of an electronic musical instrument in accordance with the invention will now be described in detail referring to the drawings.

Figure 2:
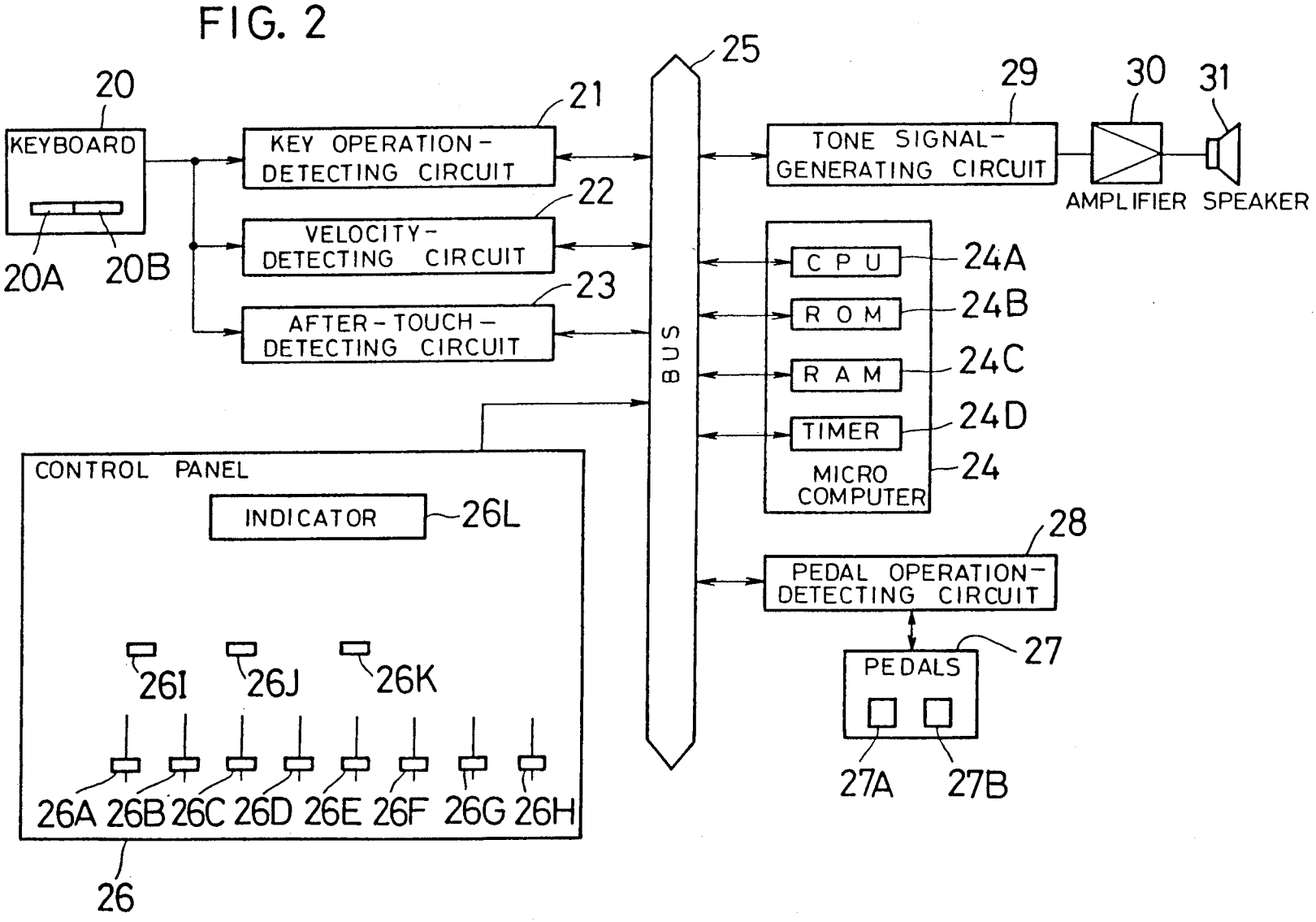

As is shown schematically in FIG. 2, the electronic musical instrument in an embodiment of the invention comprises a keyboard 20 which is composed of 61 (sixty one) keys corresponding to C2-octave to C7-octave. Four white keys included in a range from "C2" to "F2" constitute a second part 20A of the keyboard, with the remaining keys thereby constituting a first part 20B of the keyboard.

In a playing mode "1" which is a usual playing mode, musical pitches are assigned to generated musical tones by means of both of the first and the second parts 20B and 20A of the keyboard. Key-press and key-release speeds as well as key-pressures which are imparted to keys when they assign pitches to the generated musical tones are made use of to control said musical tones in this mode. A musical tone signal-generating circuit 29 generates, for each key-depression, four musical tones which are different from one another with respect to their pitches, timbres and volumes. On the other hand, in another playing mode "2" which is peculiar to the invention, the keys in the second part 20A produce control signals based on their key-press or key-release states as well as based on speeds and pressures of such key operation, while pitch assignment and tone control are likewise conducted by the first part 20B as in the playing mode "1".

In more detail, the four white keys of "C2" to "F2" produce four control signals of different kinds so as to control the generated volume for each of musical tones assigned by the keys in the first part 20B. Thus, operation of the four keys in the second part 20A of keyboard is effective to perform control of four kinds as to the generated volume of each musical tone.

A plurality of manually operable members (2) as manually operable means in the invention correspond to the four keys included in the second part 20A of keyboard. Operation of the manually operable members (2) corresponds to the operated states such as key-press and key-release, the speeds and pressure thereof as to said second part 20A of keyboard. Each of the abovementioned control signals is produced by integrating a first control signal component with a second control signal component, the first signal component being produced in accordance with the key-press and key-release and the speeds thereof, while the second signal component is produced according to the pressure of depressed keys.

Figure 6:
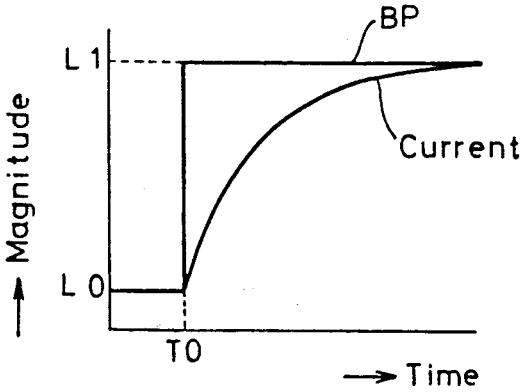
Figure 5:
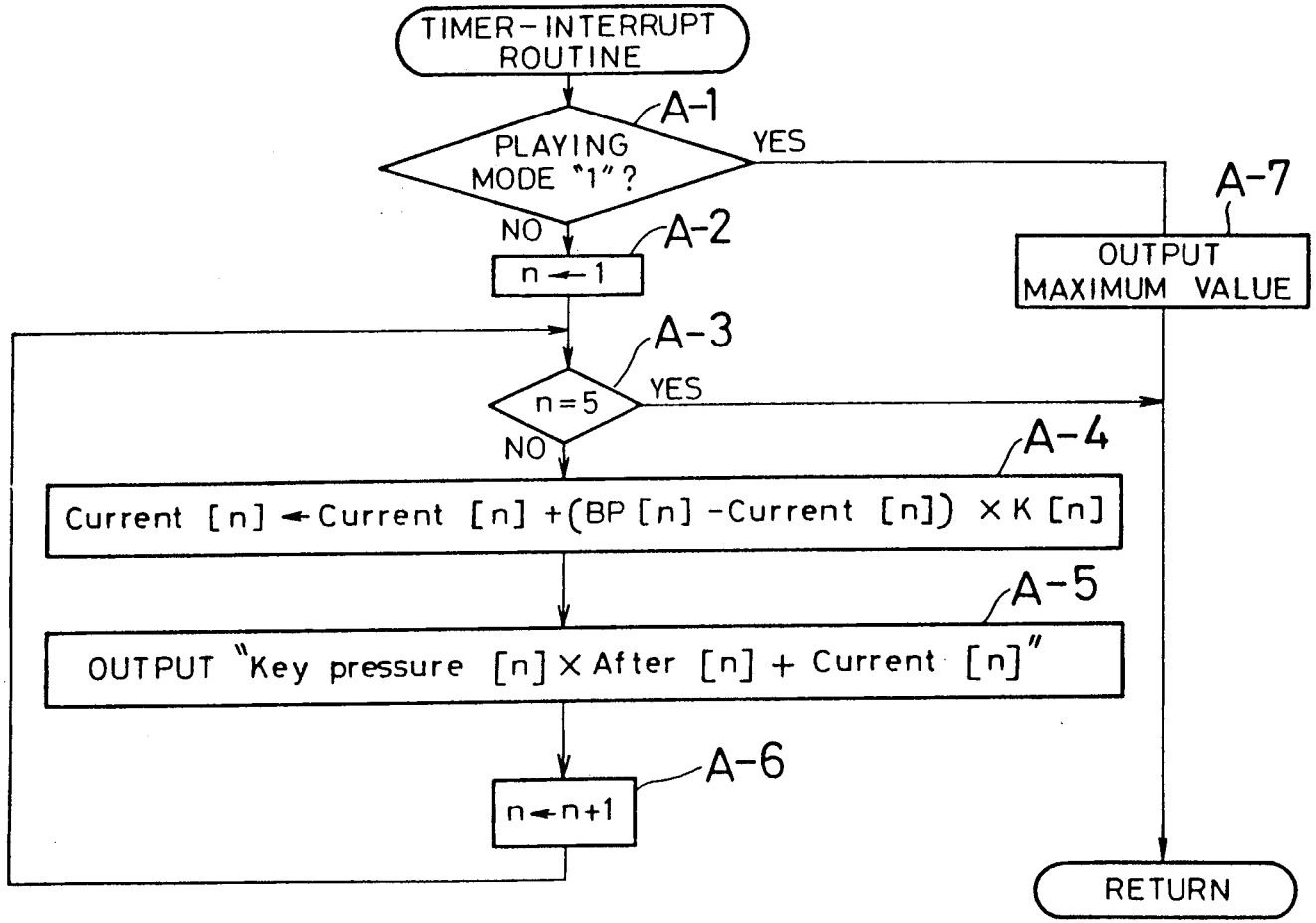

Each of the first control signal components, as will be described later in detail referring to FIGS. 5 and 6, is produced to change itself asymptotically in the course of time with a given sharpness of change until it reaches a given ultimate or target level. The sharpness of change and the target level are provided by operation of the keys included in the second part 20A of keyboard, in particular by the key-press and key-release and the speeds thereof. The electronic musical instrument further comprises a key operation-detecting circuit 21 for sensing operation, i.e., key-press and key-release, of the keys on the keyboard 20, a velocity detecting circuit 22 for sensing speeds of the key-press and key-release and an after-touch-detecting circuit 23 for sensing pressures imparted to the keys on the keyboard 20 when they are depressed. Data which are produced as key informations by these circuits are then fed to a microcomputer 24 through a bus 25, under control of said microcomputer.

A control panel 26 also included in the musical instrument comprises setting members 26A to 26K and an indicator 26L which are shown in the drawing, as well as other manual members such as a timbre selection switch and a write-commanding switch which are not shown. Operations of these members also are detected under control of and fed to the microcomputer 24 so that data or informations obtained thereby are indicated on the indicator 26L also under control of said microcomputer.

The setting members which relate to the invention but do not constitute the manually operable members (2) are now described.

Setting member 26A: This is utilized to preset standard or target values for magnitudes of the first control signal components which are produced by key-press (key-ON) of the keys on the second part 20A of keyboard.

Setting member 26B: This is utilized to preset values of another type relative to magnitudes of the first control signal components which are produced according to the speed of key-press of the keys on the second part 20A of keyboard.

Setting member 26C: This is utilized to preset still another values relative to the sharpness of change in the course of time of the first control signal components which are produced when the keys on the second part 20A are depressed.

Setting member 26D: This is utilized to preset further values relative to the sharpness of change in the course of time of the first control signal components in order to cause the sharpness to depend upon the key-press speeds of the keys on said second part 20A of keyboard.

Setting member 26E: This is utilized to preset still further values relative to the sharpness of change in the course of time of the first control signal components which are produced when the depressed keys on the second part 20A are released.

Setting member 26F: This is utilized to preset yet still further values relative to the sharpness of change in the course of time of the first control signal components in order to cause the sharpness to depend upon the key-release speeds of the keys on said second part 20A of keyboard.

Setting member 26G: This member presets a threshold value "Vt" of key-press speed which is utilized to cause the first control signal components to attenuate to "0" when the keys are depressed during a "hold" mode described later.

Setting member 26H: This member is used to preset values relevant to relationship between the pressure of depressed keys on second part 20A of keyboard and the magnitudes of said second control signal components produced.

The above setting members 26A to 26H are manipulated to select various relationships between the control signals and the operation of second part 20A of keyboard during a presetting mode described below.

Setting member (switch) 26I: This is used to effect shift or changeover between the "hold" mode and another (non-hold) mode. The shift from the former to the latter and vice versa takes place whenever this setting member 26I is operated. In the non-hold mode, the four first control signal components are produced independently upon one another, based on the key-press and key-release and the speeds thereof of the four keys on second part 20A of keyboard, respectively Key-press gives rise to the first control signal components, while key-release attenuates same. In the "hold" mode, however, any key-release itself cannot cause such an attenuation of the first control signal components but can do so only if the other key is depressed after one key has been released In this case, so-called "crossing" fade effects are easily produced because a previous musical tone continues to gradually attenuate until an instant when a new musical tone comes forth. If a key-press speed of the newly depressed key is below the threshold value "Vt", then the first control signal components for keys other than the newly depressed key do not attenuate, with only said signal component for said newly depressed key thus attenuating to "0". Changeover between the "hold" mode and another (non-hold) mode may also be carried out by means of a pedal 27A described later.

Setting member (switch) 26J: This is used to make selection between operation modes. The operation modes include a playing mode "1", a playing mode "2" and a presetting mode. Changeover from one mode to another take place step-wise in the order mentioned above every time when the setting member 26J is operated. In a state wherein one of the playing modes "1" and "2" is currently effective, another pedal 27B also provide means to make a changeover among the modes.

Setting member (switch) 26K: This member is used to select one key among the four keys "C2" to "F2" on the second part 20A of keyboard which is to be preset during the presetting mode. Each operation of this member 26K causes a sequential changeover from one key to the other. The setting of functions assigned to the keys on second part 20A of keyboard is done for respective keys by means of the setting members 26A to 26F and 26H, whereas setting by means of the setting member 26G is common to all the keys whichever thereof is adjusted as to its assigned function. A pedal group 27 comprises the pedals 27A and 27B. The pedal 27A serves for the changeover between the "hold" mode and the non-hold mode, the changeover occurring every time the pedal 27A is operated. The other pedal 27B is operated either during the playing modes "1" or during the playing mode "2" so as to effect changeover from the former to the latter or vice versa, also such changeover occurring each time the pedal 27B is operated. Operation of the pedal group 27 is detected by a pedal operation-detecting circuit 28 to produce pedal data which the microcomputer 24 controls to receive same through the bus 25.

The microcomputer 24 comprises a central processing unit (CPU) 24A adapted to execution of given programs, a read-only memory (ROM) 24B provided for storing the given programs, a random access memory (RAM) 24C necessary to execution of the programs, and a timer circuit 24D for the counting of time lapse during said programs. The random access memory (RAM) 24B has areas defined therein which include a memory zone and a working zone wherein musical tone data and other data are written into the memory zone, while the working zone comprises various registers, data tables and other small areas necessary to the function of the microcomputer.

The RAM 24C is supported with a backup battery so as not to break or lose the data written therein even in the event of a power failure. The programs referred to above are executed by the microcomputer 24 on the basis of the tone data, the key informations (such as the states as to key-press and key-release, the speeds thereof and the pressures imparted to the keys) and other data in order to control a musical tone signal-generating circuit 29. The musical tone signal-generating circuit 29 comprises 32 (thirty two) tone-generators. The microcomputer 24 select four of the tone-generators for each depression of the keys which are operated for generation of musical tones (i.e., for assignment of musical pitches) The selected tone-generators receive, from the microcomputer, control signals designating pitches, timbres, volumes and other parameters which are used by said tone-generators to generate musical tone signals of four kinds. In other words, the musical tone signal-generating circuit 29 generates four different musical tone signals which are different from each other in respect of the musical pitch, the musical timbre, the volume and the other parameters. The microcomputer can deal with a plurality of key-depressions at the same time and cause the circuit to simultaneously generate 8 (eight) musical tone signals at maximum. The microcomputer 24 produces control signals of another kind when the keys for generation of musical tones are released, said control signals are given to such tone-generators that correspond to the released keys, thereby attenuating the musical tone signals. Further details of transmission of control signals to the tone-generators selected in response to key-press and key-release are not given here since they are well known in the art. Key-press and key-release of said keys for generation of musical tones replace existing data written in the RAM 24C with new data for generation of control signals, in response to the new key-press or new key-release. The microcomputer 24 further produces at regular intervals musical volume-controlling signals and supplies same to the musical tone signal-generating circuit 29.

The musical tone signal-generating circuit 29 multiplies the control signals corresponding to key-press or key-release of the keys for generation of musical tones by the musical volume-controlling signals which are given to said circuit 29 at regular intervals to thereby produce composite volume-controlling signals. Said signal-generating circuit 29 then generates final or synthetic musical tone signals based on the composite volume-controlling signals and the other control signals given from the microcomputer 24. The synthetic musical tone signals thus produced are then amplified in an amplifier 30, converted into audible sounds and output from a speaker 31.

Figure 3:
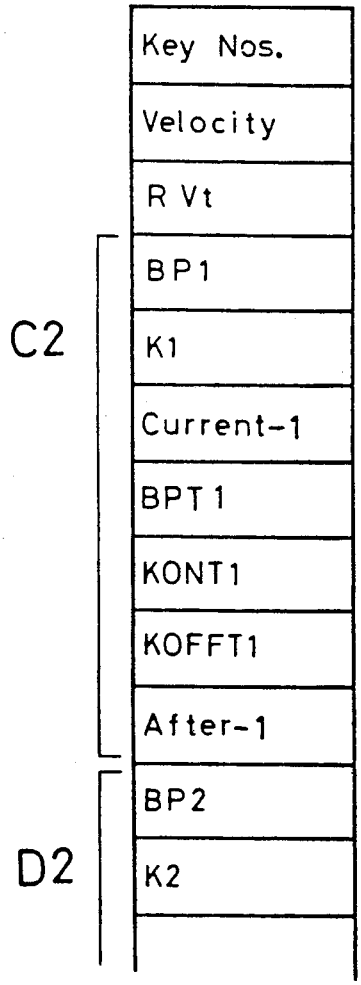

FIG. 3 shows memory areas assigned to the working zone in RAM 24C, the memory areas being used by the microcomputer 24 to execute such processings as needed in the invention. A register "Key Nos." temporarily stores a key number designating a musical pitch of newly depressed or released key. The key-press or key-release speed thereof is written in another register "Velocity". A still another register "RVt" stores the threshold value "Vt" for key-press speeds in the "hold" mode. Denoted by "BP1" to "After-1" are memory areas which are utilized to produce control signals when the key "C2" on the second part 20A of keyboard is operated. Thus, the register "BP1" is for memory of the target level of the first control signal component which has a magnitude changing in the course of time. A further register "K1" is provided to write a value corresponding to sharpness of the change in magnitude of said control signal component. A still further register "Current-1" temporarily stores a current value of the first control signal component.

A table "BPT1" stores relationships between key-press speeds and the target magnitude levels of first control signal components produced by key-press. Data on the table "BPT1" is set by means of the setting members 26A and 26B in a manner as described later referring to FIG. 4. Another table "KONT1" stores relationships between the key-press speeds and the values corresponding to sharpness of changes in the course of time of the produced first control signal component. Data on the table "KONT1" is set by means of the setting members 26C and 26D in a manner as described later referring to FIG. 4.

A still further table "KOFFT1" stores relationships between the key-release speeds and the values corresponding to sharpness of changes in the course of time of the produced first control signal components. Data on the table "KOFFT1" is set by means of the setting members 26E and 26F in a manner as described later referring to FIG. 4. Another register "After-1" stores values which represent a relationship between the pressure of key-press and the magnitude of produced second control signal component. Data on the table "After-1" is set by means of the setting member 26H. The suffix "1" carried by the memory area names "BP1" to "After-1" indicates that said areas are for the key "C2" on the second part 20A of keyboard. There are similarly provided such memory areas as will be indicated by, for example, "BP2", "BP3" and "BP4" respectively for the three other white keys "D2", "E2" and "F2" constituting the "four" keys on the second part 20A.

Figure 4:
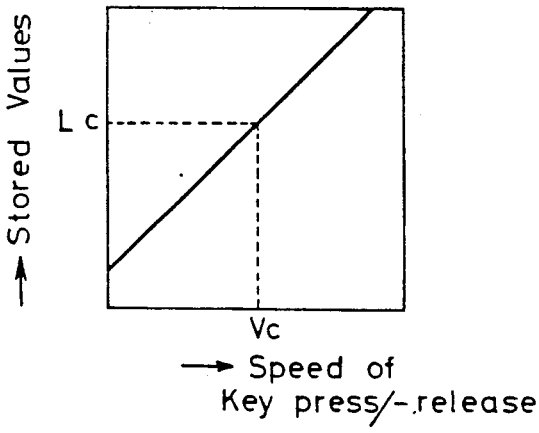

Data contained in the abovementioned tables are illustrated in FIG. 4 wherein given along the axis of abscissas are key-press and key-release speeds. The stored values are given along the axis of ordinates, a solid line in FIG. 4 shows the relationship between the key-press and/or key-release speeds and said stored values. A symbol "Vc" denotes a median value (i.e., center value between a maximum and a minimum), another symbol "Lc" denoting a value stored corresponding to the median value "Vc". The aforementioned setting members preset the value "Lc" as well as a gradient of the inclined solid line.

The aforedescribed setting members are classified into the following three groups, that is:

Group "I" including the setting members 26A 26C and 26E which are operated to preset the value "Lc";

Group "II" including the setting members 26B, 26D and 26F which are operated to preset the gradient of the solid line; and Group "III" including the setting members 26G, 26H, 26I, 26J and 26K performing functions other than those listed above.

At first, a method to make the tables will be described referring to FIG. 4. The value "Lc" is set by the setting members included in the group "I", and the gradient of an inclined solid line is set by means of the setting members included in the group "II". For example, the value "Lc" on the tables "BPT1" to "BPT4" is set by the setting member 26A, and the gradient of said inclined solid line is set by the setting member 26B. If said values thus set in such a procedure exceed a maximum or minimum value that can be received by relevant memory area or the like, then the maximum or minimum value is written thereinto in place of the actual values to be set. The setting members included in the groups "I" and "II" operated in this way make it possible to alter in various manners the relationships between the speeds of key-press or key-release and the magnitudes of the produced first control signal components or the sharpness of their changes in the course of time. The same functions as above are applicable to all the other tables.

As described above, each table carries thereon various values corresponding to key-press or key-release speeds and capable of being altered due to operation of the setting members.

Figure 7:
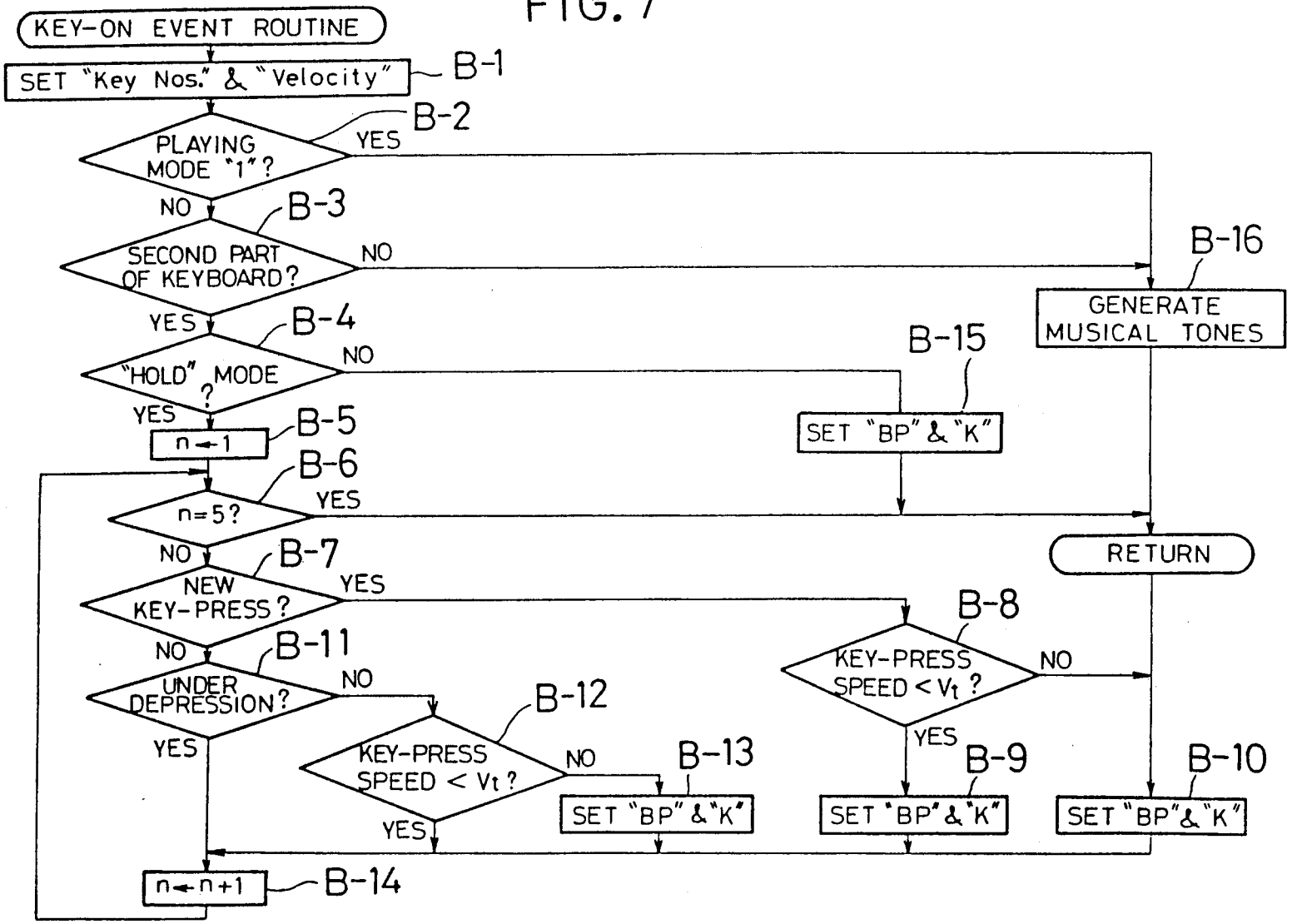
Figure 8:
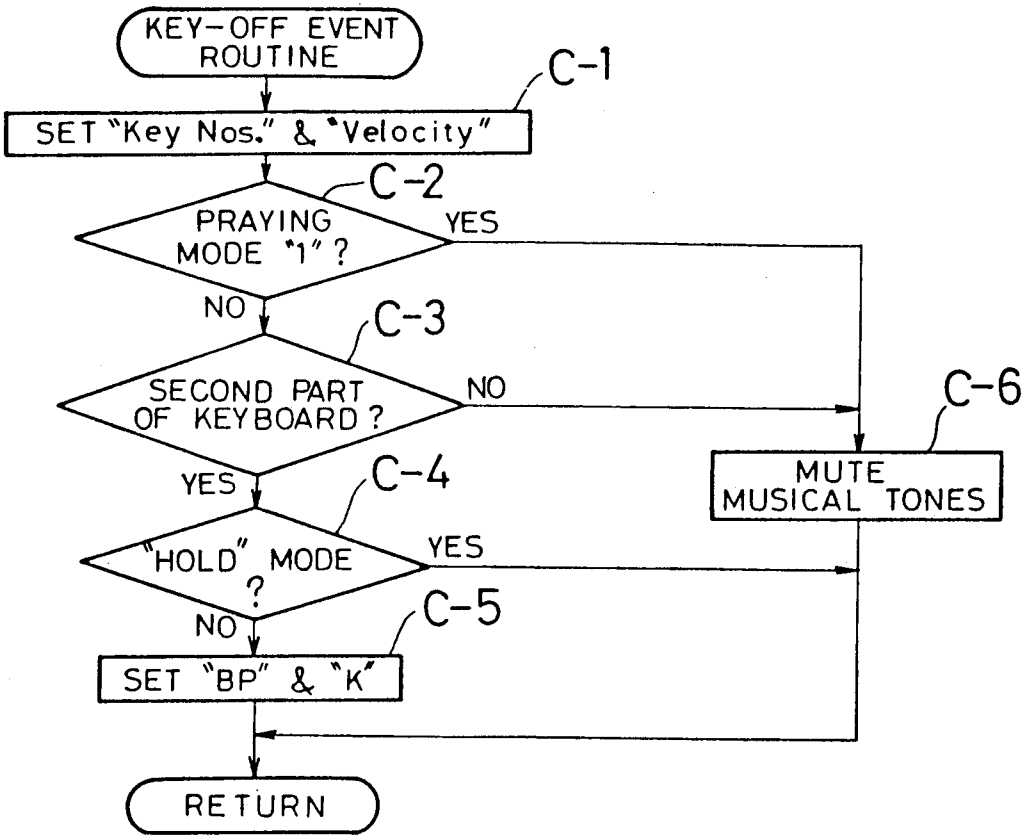

It will now be apparent that any values within a large range of the control signal values can be read from said tables according to variable operation modes of the setting members and/or according to variable key-press or key-release speeds. FIGS. 5, 7 and 8 show processings relevant to the invention and executed by the microcomputer 24 when the playing mode "1" or "2" is selected.

The producing of the control signal components is carried out corresponding to the timer-interrupts which are given by a timer circuit 24D as shown in FIG. 2, the timer circuit 24D counting time lapse during this program. At Step A1, a decision is made as to which of the playing modes "1" and "2" has been selected. If the former is the current mode, then the process goes to Step A7, while the process advances to Step A2 in a case where the playing mode "2" is on.

At Step A2, "1" is set to "n". The number "n" denotes the keys wherein "1" to "4" respectively denote the white keys "C2" to "F2". At Step A3, a decision is made as to whether "n" is "5" or not. If yes, then the process returns to the main routine processing, while the process will go to Step A4 in a case where "n" is not "5".

At Step A4, each of current values of the first control signal components is subtracted from a corresponding target value thereof, the target values being those which are stored in the registers "BP[n]", and the current values being those which are stored in the registers "Current[n]". Each of differences thus obtained is then multiplied by a corresponding one of the values which represent the sharpness of change in the course of time of said first control signal components and which are stored in the registers "K[n]". (The values stored in the registers "K[n]" are "1" or less but higher than "0".) Each of products obtained by such multiplications is added to the corresponding current value of said first signal component stored in the corresponding register "Current[n]" in order to produce a sum which is to be written thereinto as a new current value of said first component. At Step A5, a key-depression pressure of the key carrying the number "n" (shown as "Key pressure[n]" in FIG. 5) is multiplied by the corresponding value which is stored in the register "After[n]" and giving the relationship between said pressure and the second control signal component. A product (i.e., the second control signal component itself) thus obtained is added to the current value of the first signal component which is stored in the register "Current[n]". A sum thus obtained is the final musical volume-controlling signal and is supplied to the tone signal-generating circuit 29.

At Step A6, "1" is added to the current number "n". The suffix "n" in the above description denotes such memory area or key-depression pressure for the key which carries the number "n", thus "BP[n]" means "BP1" when "n" is "1".

At Step A7, a maximum which is found among the musical volume-controlling signals is supplied to the tone signal-generating circuit 29.

FIG. 6 shows the first control signal components resulting from the just described processing. The axis of abscissas denotes time lapse, and the axis of ordinates denotes magnitudes of the data stored in the registers "BP1" to "BP4" and in the registers "Current-1" to "Current-4". It is assumed that these data stored in all the registers referred to here have a value "L0" until the instant "T0". It will however be seen from FIG. 6 that when the data in the registers "BP1" to "BP4" become "L1" at the instant "T0" the other data stored in the registers "Current-1" to "Current-4" start to change at the sharpness of change stored in the further registers "K1" to "K4" so as to asymptotically towards the target values stored in the registers "BP1" to "BP4". Consequently, the first control signal components can be produced to be of various sharpness in their change in the course of time if said data in the registers "BP1" to "BP4" and in the other registers "K1" to "K4" are varied.

As will be understood from the above description, new control signal components are produced to be output and to be of magnitudes which change in the course of time at the playing mode "2", while the control signal components are invariably set at the maximum value at playing mode "1".

If any key is depressed, then a key-on event routine is executed as illustrated in FIG. 7. At Step B1, a key number of the newly depressed key is written into the register "Key Nos.", and its key-press speed is written into the register "Velocity". At Step B2, a decision is made as to which of the playing modes "1" and "2" has been selected.

If the former is the current mode, then the process goes to Step B16, while the process advances to Step B3 in a case where the playing mode "2" is on.

A decision is made at Step B3 on whether the newly depressed key is or is not one included in the second part 20A of keyboard, based on the value currently carried by the register "Key Nos." If yes, then go to Step B4, but if no, then go to Step B16.

At Step B4, a decision is made on whether the "hold" mode is currently effective or not. If yes, then go to step B5; but if no, then go to Step B15. At Step B5, "1" is set to the number "n" which denote the keys "C2" to "F2" for n=1 to n=4, respectively At Step B6, a decision is made as to whether "n" is or is not "5", and if yes, then returns to the main routine whereas the process goes to Step B7 in a case where "n" is not "5". At Step B7, a further decision is made on whether the key carrying the number "n" is or is not the newly depressed key, and if yes, then go to Step B8, but if no, then go to Step B11. At Step B8, a still further decision is made as to whether a key-depression speed of the newly depressed key is less than the threshold value "Vt" or not, and if yes, then go to Step B9, but if no, then go to Step B10.

At Step B9, selection is made to employ one of the registers "BP1" to "BP4" on the basis of the data on the register "Key Nos." so that "0" is written into the thus employed register. At the same time, further selection is made to employ one of the tables "KONT1" to "KONT4" which corresponds to the newly depressed key, the thus employed table is then read to find out the sharpness of change in the course of time of first control signal component, by means of the data stored in the register "Velocity". The sharpness of change thus found out is written into one of the registers "K138 to "K4" which corresponds to the newly depressed key.

At Step B10, one table is selected from the tables "BPT1" to "BPT4" on the basis of the value which is then carried by the register "Key Nos.", the selected table corresponding to said newly depressed key. The target value of the first control signal component is read from said selected table by referring to the value then existing on the register "Velocity", said target value then being written into one of the registers "BP1" to "BP4" which corresponds to the newly depressed key. Likewise, one table is selected from the tables "KONT1" to "KONT4" which corresponds to said newly depressed key. The value corresponding to the sharpness of change in the course of time of the first control signal component is read from the thus selected table by referring to the value then existing on the register "Velocity", said value which represents the sharpness of change then being written into one of the registers "K1" to "K4" which corresponds to the newly depressed key.

At Step B11, a decision is made on whether a key corresponding to "n" is under depression or not. If yes, then go to Step B14, but if no, then go to Step B12. At Step B12, a decision is made on whether the key-depression speed value which has been written into the register "Velocity" is or is not smaller than the threshold value "Vt". If yes, then go to Step B14, but if no, then go to Step B13.

At step B13, one register corresponding to "n" is selected from the registers "BP1" to "BP4", and "0" is written into the selected register. Further, one of the tables "KONT1" to "KONT4" is selected based on the value on the register "Key Nos." which corresponds to the newly depressed key. The value which corresponds to the sharpness of change in the course of time of the first control signal component is read from the thus selected table by referring to the value then existing on the register "Velocity", said value which represents the sharpness of change then being written into one of the registers "K1" to "K4" which carries "n" at that time. At Step B14, "1" is added to "n".

The above processings are for the "hold" mode during the playing mode "2", and are such that which are carried out when one of the keys on the second part 20A of keyboard is depressed at any key depression speed higher than the threshold value "Vt" in order that the first control signal component for the newly depressed key is caused to change in its magnitude according to said sharpness which corresponds to the key depression speed until it will reach the target magnitude which also corresponds to said speed. At the same time, the coexisting first control signal component for the key which has already been released at that time is attenuated towards "0" with the same sharpness as that for the newly depressed one. However, in the case where the new key-depression is made at any speed below the threshold value "Vt", said first control signal component for the newly depressed key is contrarily attenuated towards "0" with the sharpness of change in the course of time, the sharpness also corresponding to said key-depression speed.

At Step B15, one of the tables "KONT1" to "KONT4" is selected based on the value on the register "Key Nos." which corresponds to the newly depressed key. The value which corresponds to the sharpness of change in the course of time of the first control signal component is read from the thus selected table by referring to the value then existing on the register "Velocity", said value which represents the sharpness of change then being written into one of the registers "K1" to "K4" which carries "n" at that time. The above processing is for the case where the "hold" mode is not selected during the playing mode "2",.and is to be carried out when one of the keys on the second part 20A of keyboard is depressed so as to control the musical tones in such a manner that the first control signal component for the newly depressed key changes in its magnitude according to said sharpness which corresponds to the key depression speed until it will reach the target magnitude which also corresponds to said speed.

At Step B16, the control signals are given to musical tone signal-generating circuit 29 based as well on the data relating to the depressed key as the tone data. This means that the newly depressed key is one of the keys used to generate musical tones so that the musical tone-generating processing is executed.

On the other hand, a key-off event-routine as shown in FIG. 8 shall be executed when the key which has been depressed is newly released. At Step C1, a key number of the newly released key is written into the register "Key Nos." and its key-release speed is written into the register "Velocity".

At Step C2, a decision is made as to whether the playing mode "1" has been selected or not. If yes, then go to Step C6. If no, i.e., if the playing mode "2" has been selected, then the process advances to Step C3.

A decision is made at Step C3 on whether the newly released key is or is not included in the second part 20A of keyboard, based on the value currently carried by the register "Key Nos." If yes, then go to Step C4, but if no, then go to Step C6.

At Step C4, a decision is made on whether the "hold" mode is currently going on or not. If yes, then return to the main routine, but if no, then go to Step C5.

At Step C5, selection is made to employ one of the registers "BP1" to "BP4" on the basis of the data on the register "Key Nos " so that "0" is written into the thus employed register. At the same time, further selection is made to employ one of the tables "KOFFT1" to "KOFFT4" which corresponds to the newly depressed key, the thus employed table is then read to find out the sharpness of change in the course of time of first control signal component, by means of the data stored in the register "Velocity". The sharpness of change thus found out is written into one of the registers "K1" to "K4" which corresponds to the newly released key. The above processing is for the case where the "hold" mode is not selected during the playing mode "2", and is to be carried out when one of the keys on the second part 20A of keyboard is released for control of the musical tones in such a manner that the first control signal component for the newly released key is caused to change in its magnitude in accordance with the key release speed. On the contrary, such a processing of the first control signal component shall not be done if any key on the second part 20A is released when the "hold" mode is going on during the playing mode "2".

At Step C6, the control signals are given to musical tone signal-generating circuit 29 based as well on the data relating to the released key as the tone data. This means that the newly released key is one of the keys used to generate or mute musical tones so that the musical tone-muting processing is executed.

In summary, the abovedescribed key-on event-routine and key-off event-routine are such that if the newly depressed or released key is for control of musical tones, then the first control signal components are caused to change themselves, while the musical tone-generating or -muting processing is done in the case where said newly depressed or released key is for generation of musical tones (i.e., for assignment of pitches to musical tones).

Figure 9:
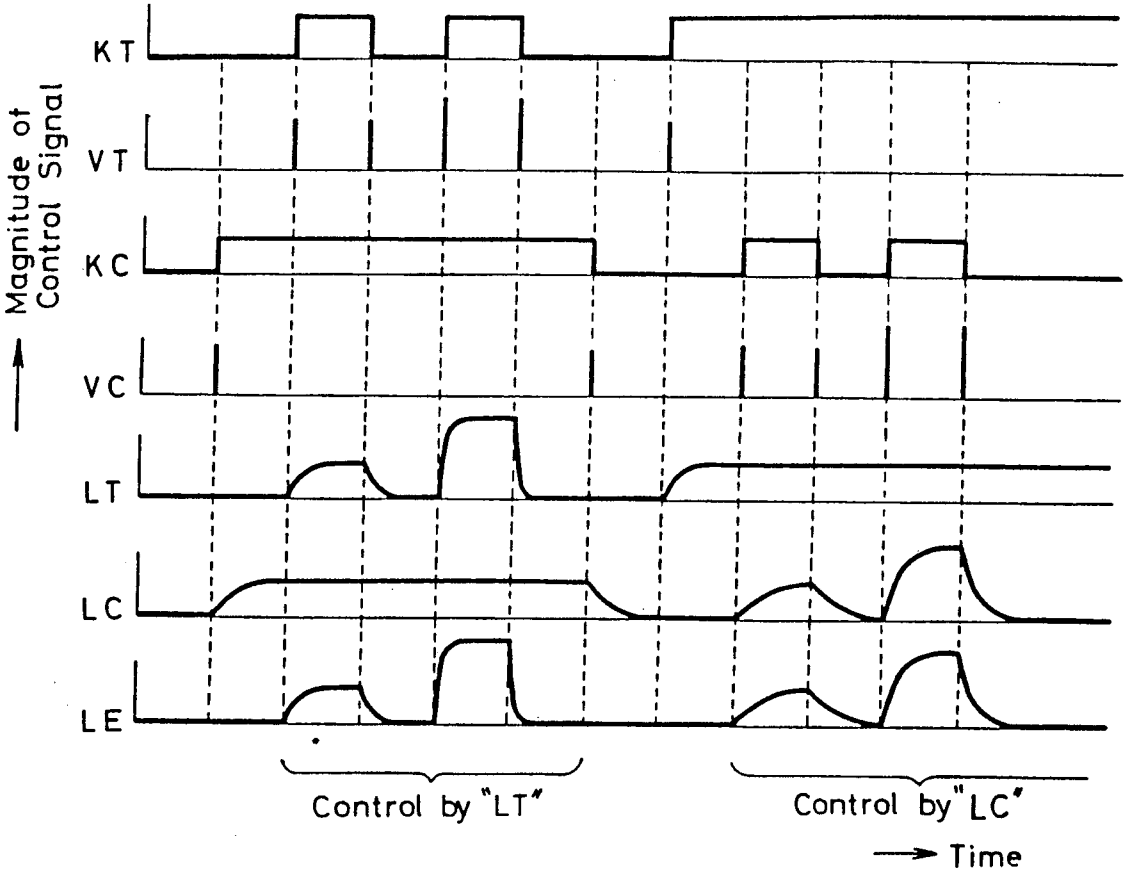
Figure 9:
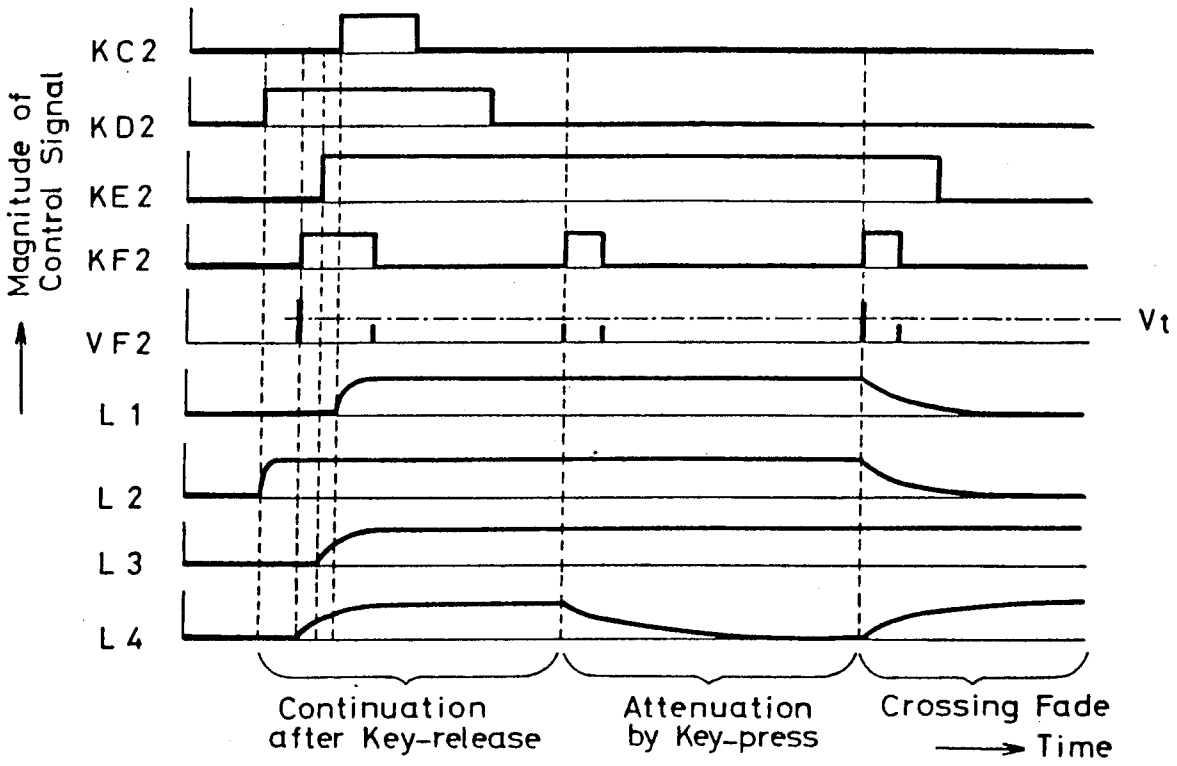

FIGS. 9(*a*) and 9(*b*) show the relationship between the control signals (i.e., said two signal components as a whole) and the key-depression or -release of the keys included in the first and second parts 20B and 20A during the playing mode "2". Here is not incorporated any key-depression pressure as to the second part 20A of keyboard.

FIG. 9(*a*) illustrates some cases where the order of key-depressions and -releases as well as their speeds are varied as to the first and second parts 20B and 20A while the "hold" mode is not turned on. The reference symbol "KT" indicates any key-depression or -release of any key on the first part 20B of keyboard (protruding areas thereby showing "key-depression"); the symbol 37 VT" indicates the speed of said key-depression or -release; the reference symbol "KC" indicates any key-depression or -release of any key on the second part 20A of keyboard; the symbol "VC" indicates the speed of said key-depression or -release; the symbol "LT" indicates the musical volume-controlling signals produced based on the key-depression or -release speeds and on the tone data as to the first part 20B of keyboard; the symbol "LC" indicates the control signals which are produced corresponding to the key-depression or -release of the keys on second part 20A ( and which here do not include any second control signal component because any key-depression pressure is not made use of in this example, thus said signals being equal to the first control signal components); and the symbol "LE" indicates final volume-controlling signals each of which is derived from each corresponding signal "LT" and each corresponding signal "LC".

As shown in FIG. 9(*a*), if any key on the first part 20B of keyboard is depressed when a significant length of time has passed after any key on the second part 20A was depressed, then the final control signal "LE" is determined by the control signal "LT" which is the musical volume-controlling signals produced based on the key-depression or -release speeds and on the tone data as to the first part 20B of keyboard. On the other hand, if any key on the second part 20A of keyboard is depressed when a significant length of time has passed after any key on the first part 20B was depressed, then the final control signal "LE" is determined by the control signal "LC" which is produced corresponding to the key-depression or -release of the keys on second part 20A. Further, any change made as to the speed of key-depression or -release causes variation of the magnitude of and the sharpness of change in the course of time of, said final control signal.

FIG. 9(*b*) illustrates a further case wherein pluralities of the keys of second part 20A of keyboard are depressed or released overlappingly and in different manners during the "hold mode". The symbols "KC2", "KD2", "KE2" and "KF2" respectively indicate the key-depression or -release states of the the keys "C2", "D2", "E2" and "F2" of said second part 20A. The symbol "VF2" indicates key-depression L or -release speed of the key "F2". Further symbols "L1", "L2", "L3" and "L4" indicate the control signals respectively corresponding to the keys "C2", "D2", "E2" and "F2" of said second part 20A of keyboard. (These control signals do not include any second control signal component because any key-depression pressure is not made use of in this example, thus said signals being equal to the first control signal components.)

As seen in FIG. 9(*b*), the control signals do not attenuate but retain their magnitudes even if any keys on said second part 20A is released immediately after depressed. A new key-depression with a speed slower than the threshold value "Vt" will however bring about an attenuation of first control signal component which corresponds to the newly depressed key.

To the contrary, a different type of new key-depression with a speed higher than the threshold value "Vt"

will however bring about a change in magnitude of the control signal corresponding to the new key-depression, the change occurring towards the target value in the course of time wherein said target value and the sharpness of said change are determined by the the speed of said key-depression. On the other hand, the magnitude of control signal derived from any key which has already been released when the key referred to above is newly depressed will attenuate with the same sharpness of change as that with which said control signal produced by the newly depressed key changes in the course of time. The new key-depression is effective to produce a "crossing" fade effect. Control signal produced by any key which remains depressed when the new key-depression is made does not attenuate whereby a decision is left to the discretion of the operator as to whether the musical tone based on the key remaining depressed.

Although only the first control signal components are described referring to FIGS. 9(*a*) and 9(*b*) which change in their magnitudes in the course of time depending upon the key-depression or -release speed accompanying the touches on the second part 20A of keyboard, any additional pressures imparted to the already depressed keys can produce the second control signal components in the described embodiment whereby more sophisticated control of musical tone volumes may be achieved.

As described hereinabove, the control signals of various kinds obtained depending upon the various types of touches of the keys on second part 20A of keyboard afford varied controls of musical tone volumes according to the embodiment of the invention.

Each table may be divided into plural areas which respectively correspond to successive ranges of key-depression or -release speed, though one straight line is used in the embodiment to indicate the relationship between the key-depression or -release speed and the resulting control signal (except for those areas outside the maximum or minimum value).

Although the same table is used for both the cases of "hold" and "non-hold" modes in the embodiment in order to store the relationship between the key-depression or -release speed and the obtained control signals, it is possible to employ two tables which are subjected to changeover from one to another according to the selected mode. In addition, such a table of the relationship between the key-depression speed and the first control signal components during the "hold" mode may be divided into two areas separated by the threshold value "Vt", thus enabling the sharpness of the "crossing" fade effects to be set independently upon the other sharpness of change of signals.

Each relationship between the key-depression or -release speed and the control signals are previously written into the tables in the above embodiment, however it may be calculated each time when necessary.

Although volume control of musical tones is performed by such a described system in the embodiment, the system may be modified to perform control of any other parameters such as pitch or timbre of each musical tone, degree of "chorus" effect or other musical effects, magnitude or speed of modulation signals, and the likes, as long as they can be treated with by the musical tone signal-generating circuit 29. A plurality of parameters may be controlled by means of any single key.

It may also be possible that a suitable memory means stores for each of the setting members disposed on the control panel 26 plural modes of relationship between operation of the keyboard's second part and control signals wherein one of the modes may be read from said memory for each setting member before starting to play music, although each setting member merely controls only one of such relationships in the embodiment. Further, each of such relationships between said operation and said control signals may be stored together with any other parameter such as timbre, musical effect or the like whereby the reading of latter parameter can simultaneously set former relation for each setting member for the keyboard's second part.

Any keys may be substituted for the keys "C2" to "F2" which are used consistently in the embodiment as the manually operable members producing detectable operation touches, if they are convenient for player's operation. There may be employed a further modified system in which some or all of the substituted keys can be chosen by the player at his discretion when he plays music. Further, any manually operable members of kinds different from the keys may be incorporated.

The above system in the embodiment is such that both the key-depression or -release speed and the key-depression pressure are utilized as the operation touches for generating the control signals, however either one of them may singly be used for the said purpose. These two touches may be changed over between them.

The manually operable members producing detectable touches may be of any type other than "keys".

Although the keyboard provides the tone pitch-assigning means in the embodiment, any other suitable members may be used as such means.

Although all of the tone pitch-assigning means, the manually operable members, the control message-producing means and the musical tone-generating means in the embodiment are incorporated in the single electronic musical instrument, they may be separately built in some instruments and interconnected one another by an information transmitting means such as an MIDI (Musical Instrument Digital Interface).

Although the musical tone-controlling messages in the embodiment are of magnitudes which exponentially change in the course of time, the magnitudes may change linearly giving straight lines with respective gradients which may be utilized as the sharpness of change.

Furthermore, any other number of musical tones may be generated for one key-depression, although four musical tones are generated in the embodiment. Any desirable timbres may be assigned to any keys for control of musical tones, though no reference has been made to such a case.

What is claimed is:

1. An electronic musical instrument comprising:

(a) tone pitch-assigning means for assigning pitches to musical tones to be generated, said tone pitch-assigning means including first manually operable members;

(b) a plurality of second manually operable members which are operable by touch;

(c) control message-producing means for producing musical tone-controlling messages which have control magnitudes that are changed in response to operation of said second manually operable members from an OFF-state to an ON-state or from an ON-state to an OFF-state;

(d) means for detecting speeds at which said second manually operable members are operated, said control magnitudes of said tone-generating messages further changing in time depending upon operation speeds of said second manually operable members detected by said detecting means; and (e) musical tone-generating means for generating a plurality of musical tones which each have a musical pitch assigned by said tone pitch-assigning means, and a volume determined by said musical tone-generating means based upon said control magnitudes of said tone-controlling messages, said control message-producing means determining target values and change sharpness for said control magnitudes based upon operation speeds detected by said detecting means, and said control magnitudes of said tone-controlling messages changing toward said target values at a rate given by said change sharpness.

2. An electronic musical instrument comprising:

(a) tone pitch-assigning means for assigning pitches to musical tones to be generated, said tone pitch-assigning means including first manually operable members;

(b) a plurality of second manually operable members which are operable by touch;

(c) a control message-producing means for producing musical tone-controlling messages which have control magnitudes that are changed in time in response to operation of said second manually operable members from an OFF-state to an ON-state of said members, but are not changed in response to operation of said second manually operable members from an ON-state to an OFF-state;

(d) means for detecting speeds at which said second manually operable members are operated, said control magnitudes of said tone-generating messages further changing in time depending upon operation speeds of said second manually operable members detected by said detecting means; and (e) musical tone-generating means for automatically generating a plurality of musical tones which each have a musical pitch assigned by said tone pitch-assigning means, and a volume determined by said musical tone-generating means based upon said tone-controlling messages, said control message-producing means determining target values and change sharpness for said control magnitudes based upon operation speeds detected by said detecting means, and said control magnitudes of said tone-controlling messages changing toward said target values at a rate given by said change sharpness.

3. An electronic musical instrument comprising:

(a) tone pitch-assigning means for assigning pitches to musical tones to be generated, said tone pitch-assigning means including first manually operable members;

(b) a plurality of second manually operable members;

(c) a control message-producing means for producing musical tone-controlling messages which have control magnitudes that are changed in time in response to operation of said second manually operable members from an OFF-state to an ON-state of said members, but are not changed in response to operation of said second manually operable members from an ON-state to an OFF-state; and (d) musical tone-generation means for automatically generating a plurality of musical tones which each have a musical pitch assigned by said tone pitch-assigning means, and a volume determined by said musical tone-generating means based upon said tone-controlling messages, said second manually operable members comprising a first member and a second member, wherein operation of said second member after operation of said first member causes said control message-producing means to change said control magnitude of said message produced in response to operation of said first member, and thereby causes a musical tone produced by said instrument to be attenuated.

4. An electronic musical instrument as set forth in claim 3, wherein operation of said second member does not change said control magnitude of said message produced in response to operation of said first member unless said first member has been returned to its OFF-state prior to operation of said second member.

5. An electronic musical instrument as set forth in claim 4, wherein operation of said second member does not change said magnitude of said message produced in response to operation of said first member unless said second member also is operated at a speed higher than a predetermined operation speed.

6. An electronic musical instrument comprising:

(a) tone pitch-assigning means for assigning pitches to musical tones to be generated, said tone pitch-assigning means including first manually operable members;

(b) a plurality of second manually operable members;

(c) a control message-producing means for producing musical tone-controlling messages which have control magnitudes that are changed in time in response to operation of said second manually operable members from an OFF-state to an ON-state of said members, but are not changed in response to operation of said second manually operable members from an ON-state to an OFF-state; and (d) musical tone-generating means for automatically generating a plurality of musical tones which each have a musical pitch assigned by said tone pitch-assigning means, and a volume determined by said musical tone-generating means based upon said tone-controlling messages, said control message-producing means further changes a control magnitude of a message produced in response to operation of at least one of said second manually operable members if said at least one member, after being operated from its OFF-state to its ON-state, and then again to its OFF-state, is thereafter operated back to its ON-state at a speed which is lower than a predetermined operation speed, said musical tone produced by said instrument is attenuated.

* * * * *